US010799893B2

(12) United States Patent
Fujiwara

(10) Patent No.: US 10,799,893 B2
(45) Date of Patent: Oct. 13, 2020

(54) TRIGGER-TYPE LIQUID EJECTOR

(71) Applicant: Kotaro Fujiwara, Tokyo (JP)

(72) Inventor: Kotaro Fujiwara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 80 days.

(21) Appl. No.: 15/754,555

(22) PCT Filed: Aug. 24, 2016

(86) PCT No.: PCT/JP2016/074572
§ 371 (c)(1),
(2) Date: Feb. 22, 2018

(87) PCT Pub. No.: WO2017/038564
PCT Pub. Date: Mar. 9, 2017

(65) Prior Publication Data

US 2018/0243765 A1 Aug. 30, 2018

(30) Foreign Application Priority Data

Aug. 31, 2015 (JP) ..... 2015-170871

(51) Int. Cl.
*B05B 7/00* (2006.01)
*B05B 11/00* (2006.01)
(Continued)

(52) U.S. Cl.
CPC ..... *B05B 7/005* (2013.01); *B05B 1/3013* (2013.01); *B05B 7/0056* (2013.01);
(Continued)

(58) Field of Classification Search
CPC ..... B05B 7/005; B05B 1/3013; B05B 7/0056; B05B 7/0425; B05B 11/0032;
(Continued)

(56) References Cited

U.S. PATENT DOCUMENTS 4,350,298 A * 9/1982 Tada ..... B05B 7/005 239/333
4,953,791 A 9/1990 Tada
(Continued)

FOREIGN PATENT DOCUMENTS

CN 1171301 A 1/1998
JP S55-035962 U 3/1980
(Continued)

OTHER PUBLICATIONS

Nov. 22, 2016 International Search Report issued in International Patent Application No. PCT/JP2016/074572.
(Continued)

*Primary Examiner* — Tuongminh N Pham
(74) *Attorney, Agent, or Firm* — Oliff PLC

(57) ABSTRACT

A trigger-type liquid ejector which includes an ejector main body and a nozzle member in which an ejection hole is formed, the ejector main body including a vertical supply tubular pipe, an injection tubular portion, and a trigger mechanism, the nozzle member including a nozzle main body and a valve body, the nozzle main body including a valve seat portion having a valve seat plate, an inside of the valve seat plate communicating with the ejection hole, the nozzle main body including a tubular foam-forming portion positioned in a front of the ejection hole and configured to surround the ejection hole, and the foam-forming portion is provided with an outside air introduction hole penetrating through the foam-forming portion in a radial direction thereof.

4 Claims, 4 Drawing Sheets

(51) Int. Cl.
*B05B 1/30* (2006.01)
*B05B 7/04* (2006.01)

(52) U.S. Cl.
CPC ..... *B05B 7/0425* (2013.01); *B05B 11/0032* (2013.01); *B05B 11/0067* (2013.01); *B05B 11/3011* (2013.01); *B05B 11/3057* (2013.01); *B05B 11/3067* (2013.01); *B05B 11/0008* (2013.01); *B05B 11/3077* (2013.01)

(58) Field of Classification Search
CPC ..... B05B 11/0067; B05B 11/3011; B05B 11/3057; B05B 11/3067; B05B 11/0008; B05B 11/3077
USPC ..... 239/333; 222/380, 383.1–383.3
See application file for complete search history.

(56) References Cited

U.S. PATENT DOCUMENTS 5,335,858 A 8/1994 Dunning et al.
5,590,834 A * 1/1997 Foster ..... B05B 11/0005 239/333
5,636,768 A * 6/1997 Yamada ..... B05B 11/0032 222/383.1

FOREIGN PATENT DOCUMENTS

| | | | |
|---|---|---|---|
| JP | S55-035978 | U | 3/1980 |
| JP | S56-067551 | A | 6/1981 |
| JP | S56-133358 | U | 10/1981 |
| JP | S56-133362 | U | 10/1981 |
| JP | S58-137463 | U | 9/1983 |
| JP | H01-203065 | A | 8/1989 |
| JP | 2006-204989 | A | 8/2006 |
| JP | 2008-296144 | A | 12/2008 |
| JP | 2015-063345 | A | 4/2015 |
| WO | 03/045571 | A1 | 6/2003 |

OTHER PUBLICATIONS

Feb. 3, 2019 Chinese Office Action issued in Chinese Patent Application No. 201680049684.1.
Mar. 14, 2019 Extended European Search Report issued in European Patent Application No. 16841596.6.

* cited by examiner

TRIGGER-TYPE LIQUID EJECTOR

TECHNICAL FIELD

The present invention relates to a trigger-type liquid ejector. Priority is claimed on Japanese Patent Application No. 2015-170871, filed Aug. 31, 2015, the content of which is incorporated herein by reference.

BACKGROUND ART

A trigger-type liquid ejector described in the following Patent Document 1 is known. This trigger-type liquid ejector includes an ejector main body mounted on a container in which a liquid is contained, and a nozzle member disposed in the front of the ejector main body and having an ejection hole which ejects the liquid toward the front formed therein. The ejector main body includes a vertical supply tubular pipe which extends in a vertical direction and through which the liquid in the container is suctioned up, an injection tubular portion which extends forward from the vertical supply tubular pipe and whose inside is configured to communicate with an inside of the vertical supply tubular pipe, and a trigger mechanism having a trigger extending downward from the injection tubular portion and disposed to be swingable rearward in a state of being biased forward, and configured to introduce the liquid from the inside of the vertical supply tubular pipe into the injection tubular portion and inject the liquid from an inside of the injection tubular portion toward the ejection hole side when the trigger swings rearward. The nozzle member includes a nozzle main body having a connection tubular portion connected to the injection tubular portion and a valve body provided inside the connection tubular portion to be movable rearward and forward in a state of receiving forward force. The nozzle main body includes a valve seat portion having an annular valve seat plate which is disposed inside the connection tubular portion and on which a front end portion of the valve body is seated. Thus, an inside of the valve seat plate communicates with the ejection hole. In this trigger-type liquid ejector, when the trigger is swung rearward, the liquid is injected from the inside of the vertical supply tubular pipe into an inside of the connection tubular portion through the inside of the injection tubular portion. When the internal pressure inside the connection tubular portion exceeds a predetermined value, the valve body separates from the valve seat plate and the liquid is ejected from the ejection hole.

CITATION LIST

Patent Document

[Patent Document 1]
Japanese Unexamined Patent Application, First Publication No 2006-204989

SUMMARY OF INVENTION

Technical Problem

Incidentally, in such a conventional trigger-type liquid ejector as described above, it is desired that a liquid be foamed and discharged.

The present invention is made in consideration of the above-described circumstances, and an object of the present invention is to provide a trigger-type liquid ejector in which a liquid is foamed and discharged.

Solution to Problem

In order to solve the above problem, the present invention proposes the following means.

A first aspect of the present invention is a trigger-type liquid ejector which includes an ejector main body mounted on a container in which a liquid is contained, and a nozzle member which is disposed in a front of the ejector main body and in which an ejection hole through which the liquid is ejected forward is formed. The ejector main body includes a vertical supply tubular pipe which extends in a vertical direction and through which the liquid in the container is suctioned up, an injection tubular portion which extends forward from the vertical supply tubular pipe and whose inside is configured to communicate with an inside of the vertical supply tubular pipe, and a trigger mechanism including a trigger extending downward from the injection tubular portion and disposed to be swingable rearward in a state of receiving forward force, and the trigger mechanism is configured to introduce the liquid from the inside of the vertical supply tubular pipe into the injection tubular portion and to inject the liquid from the inside of the injection tubular portion toward the ejection hole side when the trigger swings rearward. The nozzle member includes a nozzle main body including a connection tubular portion connected to the injection tubular portion, and a valve body provided inside the connection tubular portion to be movable rearward and forward in a state of receiving forward force. The nozzle main body includes a valve seat portion including an annular valve seat plate which is disposed inside the connection tubular portion and on which a front end portion of the valve body is seated. An inside of the valve seat plate communicates with the ejection hole. The nozzle member includes a tubular foam-forming portion positioned in a front of the ejection hole and configured to surround the ejection hole. The foam-forming portion is provided with an outside air introduction hole penetrating through the foam-forming portion in a radial direction thereof.

According to the trigger-type liquid ejector according to the first aspect of the present invention, when the trigger is swung rearward, the liquid is injected from the inside of the vertical supply tubular pipe into an inside of the connection tubular portion through the inside of the injection tubular portion. When an internal pressure of the inside of the connection tubular portion exceeds a predetermined value, the valve body is moved rearward against a forward urging force. Then, the front end portion of the valve body is separated from the valve seat plate, the inside of the injection tubular portion and the ejection hole communicate with each other through the inside of the connection tubular portion, and the liquid is ejected from the ejection hole through an inside of the foam-forming portion. At this time, since outside air (air) is also introduced into the foam-forming portion through the outside air introduction hole, the liquid is mixed with the outside air in the foam-forming portion to form foam, which is ejected from a front end opening of the foam-forming portion. Further, when the foam-forming portion is formed to be short, it is possible to eject the foamy liquid in a wide range in a dispersed manner, and when the foam-forming portion is formed to be long, it is possible to eject the foamy liquid in a narrow range in a concentrated manner. Thereafter, when the internal pressure inside the connection tubular portion is lowered, the valve body is moved forward by the forward urging force, the front end portion of the valve body is seated on the valve seat plate, and the communication between the injection tubular portion and the ejection hole is blocked.

As described above, according to the trigger-type liquid ejector according to the first aspect of the present invention, by ejecting the liquid from the ejection hole through the foam-forming portion, the liquid can be foamed and ejected. Further, by changing a form of the foam-forming portion, as described above, it is possible to adjust a range in which the foamy liquid is ejected. Therefore, since the foam-forming portion is formed to be separated from the nozzle main body and a modification is limited to a form of the foam-forming portion, it is possible to variously adjust a range in which the foamy liquid is ejected without modifying the shape of the nozzle main body or the shape of the ejector main body to which the nozzle main body is connected. Here, when the liquid is foamed, outside air is introduced into the foam-forming portion from the outside air introduction hole while the liquid is ejected into the foam-forming portion, and thereby the liquid mixes with the outside air and foams bubbles. The liquid ejected into the foam-forming portion is ejected from the ejection hole when the internal pressure inside the connection tubular portion exceeds a predetermined value and is ejected from the ejection hole at a high speed. Therefore, when the liquid is ejected into the foam-forming portion, since outside air is effectively introduced into the foam-forming portion from the outside air introduction hole by reducing an internal pressure of the foam-forming portion, it is possible to form the liquid into fine bubbles. As a result, for example, in a case in which the foam-forming portion is formed to be long and the foamy liquid is ejected in a narrow range in a concentrated manner or the like, it is possible to enhance the adhesion force of the liquid to an object as compared with a case in which the liquid is ejected to the object in a liquid state as it is, and thereby the liquid colliding with the object can be prevented from scattering to the surroundings. That is, when the liquid is ejected in a liquid state as it is, since a force of the liquid ejected from the ejection hole is excessively strong, there is a possibility of the liquid being scattered to the surroundings depending on objects.

According to a second aspect of the present invention, in the trigger-type liquid ejector of the first aspect, the nozzle member may include a lid body which is configured to openably close the foam-forming portion and the lid body may be connected to the nozzle main body to be rotatable forward.

According to the trigger-type liquid ejector according to the second aspect of the present invention, since the nozzle member includes the lid body, unexpected ejection of the liquid can be reliably prevented.

Advantageous Effects of the Invention

According to the trigger-type liquid ejector of the present invention, a liquid can be foamed and ejected.

DESCRIPTION OF EMBODIMENTS

Figure 1:
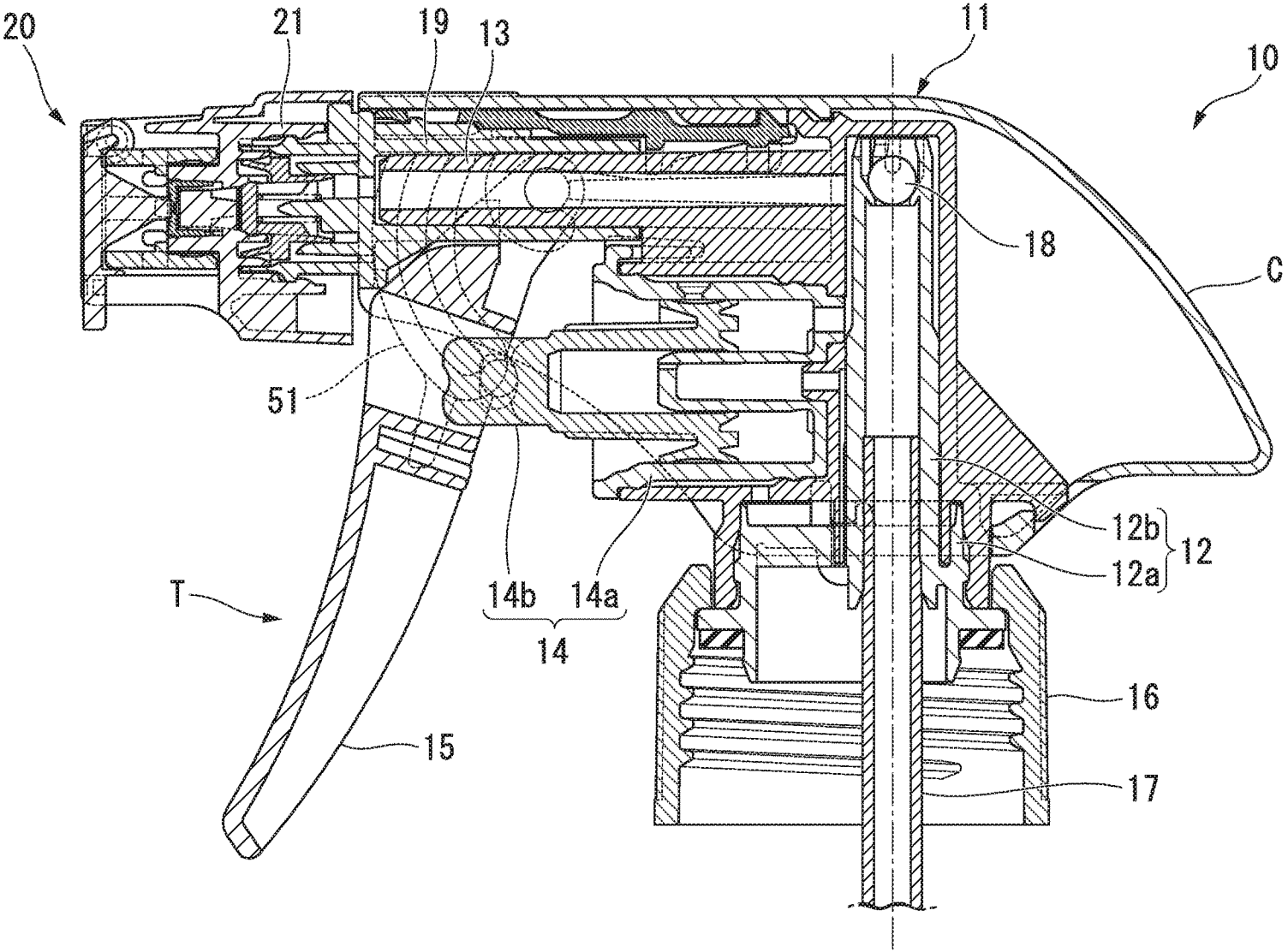
FIG. 1 is a longitudinal sectional view of a trigger-type liquid ejector shown as an embodiment according to the present invention.

Hereinafter, an embodiment of a trigger-type liquid ejector according to the present invention will be described with reference to FIGS. 1 to 4. The trigger-type liquid ejector 10 according to this embodiment includes an ejector main body 11 mounted on a container (not shown) in which a liquid is contained, and a nozzle member 20 provided at a front end of the ejector main body 11 and having an ejection hole 26*a* for ejecting a liquid toward the front formed therein. A vertical supply tubular pipe 12 which extends in a vertical direction and through which a liquid in the container is suctioned up, an injection tubular portion 13 extending forward from this vertical supply tubular pipe 12 and having an inside communicating with an inside of the vertical supply tubular pipe 12, a trigger mechanism T having a trigger 15 suspended to be swingable in a forward and rearward direction, and a cover body C covering the vertical supply tubular pipe 12, the injection tubular portion 13, and a cylinder 14*a* to be described below from above, a rear, and right and left, are provided in the ejector main body 11.

Here, in the present embodiment, when a central axis of the vertical supply tubular pipe 12 is taken as an axis, a direction along this axis is referred to as a vertical direction, a container side in the vertical direction is referred to as a lower side, and the opposite side thereto is referred to as an upper side. Among directions perpendicular to the direction along the axis (the vertical direction), a direction along the injection tubular portion 13 is referred to as a forward and rearward direction, and a direction perpendicular to the forward and rearward direction (that is, a direction perpendicular to both the vertical direction and the forward and rearward direction) is referred to as a lateral direction.

The vertical supply tubular pipe 12 is a multistage-shaped tubular body including a large diameter portion 12*a* and a small diameter portion 12*b* extending upward from the large diameter portion 12*a*. A mounting tubular portion 16 mounted on a mouth portion of the container is provided on the large diameter portion 12*a*. A pipe 17 is fitted to the small diameter portion 12*b*. A lower end opening of the pipe 17 is positioned at a bottom portion inside the container when the mounting tubular portion 16 is mounted on the mouth portion. A suction valve 18 is provided at an upper end opening of the small diameter portion 12*b*. When an inside of a cylinder 14*a* of a reciprocating pump 14 to be described below is pressurized, the suction valve 18 is closed to block communication between an inside of the pipe 17 and an inside of the injection tubular portion 13, and when the inside of the cylinder 14*a* of the reciprocating pump 14 is depressurized, the suction valve 18 is opened to connect the inside of the pipe 17 to the inside of the injection tubular portion 13.

The trigger 15 extends downward from the injection tubular portion 13 and is arranged to be swingable rearward in a state of receiving forward force. Due to the trigger 15 swinging rearward, the trigger mechanism T causes a liquid to be introduced from the inside of the vertical supply tubular pipe 12 into the injection tubular portion 13 and to be injected from the inside of the injection tubular portion 13 toward the ejection hole 26*a*. The trigger mechanism T includes the reciprocating pump 14 having the cylinder 14*a* whose inside is pressurized and depressurized according to a rearward and forward movement of the trigger 15 and an elastic member 51 which urges the trigger 15 forward.

The cylinder 14*a* extends in the forward and rearward direction and opens forward. The cylinder 14*a* is formed separately from the vertical supply tubular pipe 12 and is assembled to a front surface of the vertical supply tubular pipe 12. A plunger 14*b* is fitted into the cylinder 14*a* to be slidable rearward and forward from its front end opening. The trigger 15 is connected to a front end of the plunger 14*b*. Accordingly, when the plunger 14*b* moves rearward and forward with respect to the cylinder 14*a* in accordance with rearward and forward movement of the trigger 15, the internal pressure of the cylinder 14*a* is increased and decreased. A pair of elastic members 51 are disposed to surround the injection tubular portion 13 in the lateral direction. An upper end portion of each elastic member 51 is fixed to the injection tubular portion 13 and a lower end portion of each elastic member 51 is fixed to the plunger 14*b*.

Figure 2:
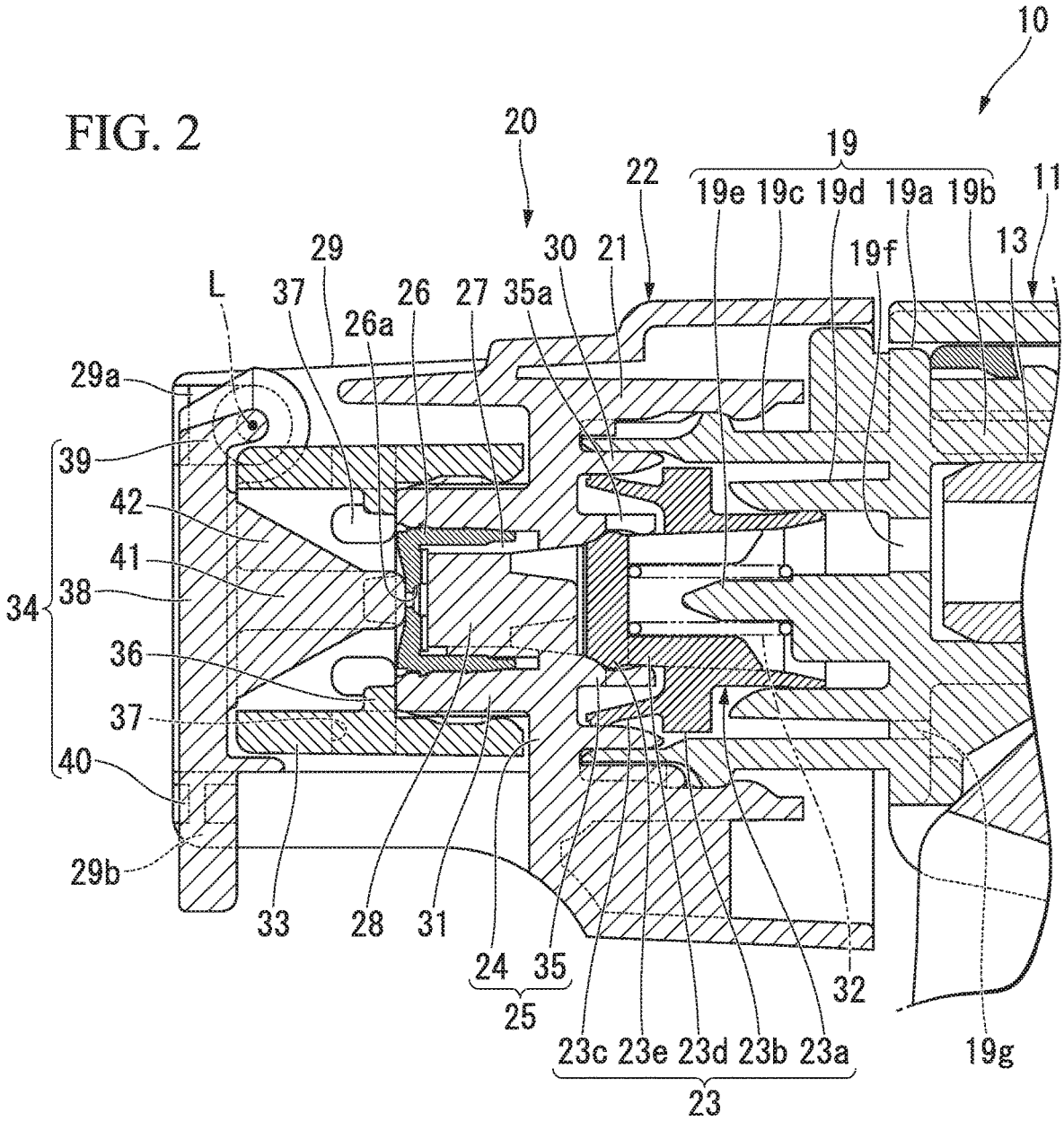
FIG. 2 is an enlarged view of a main portion of the trigger-type liquid ejector shown in FIG. 1.
Figure 3:
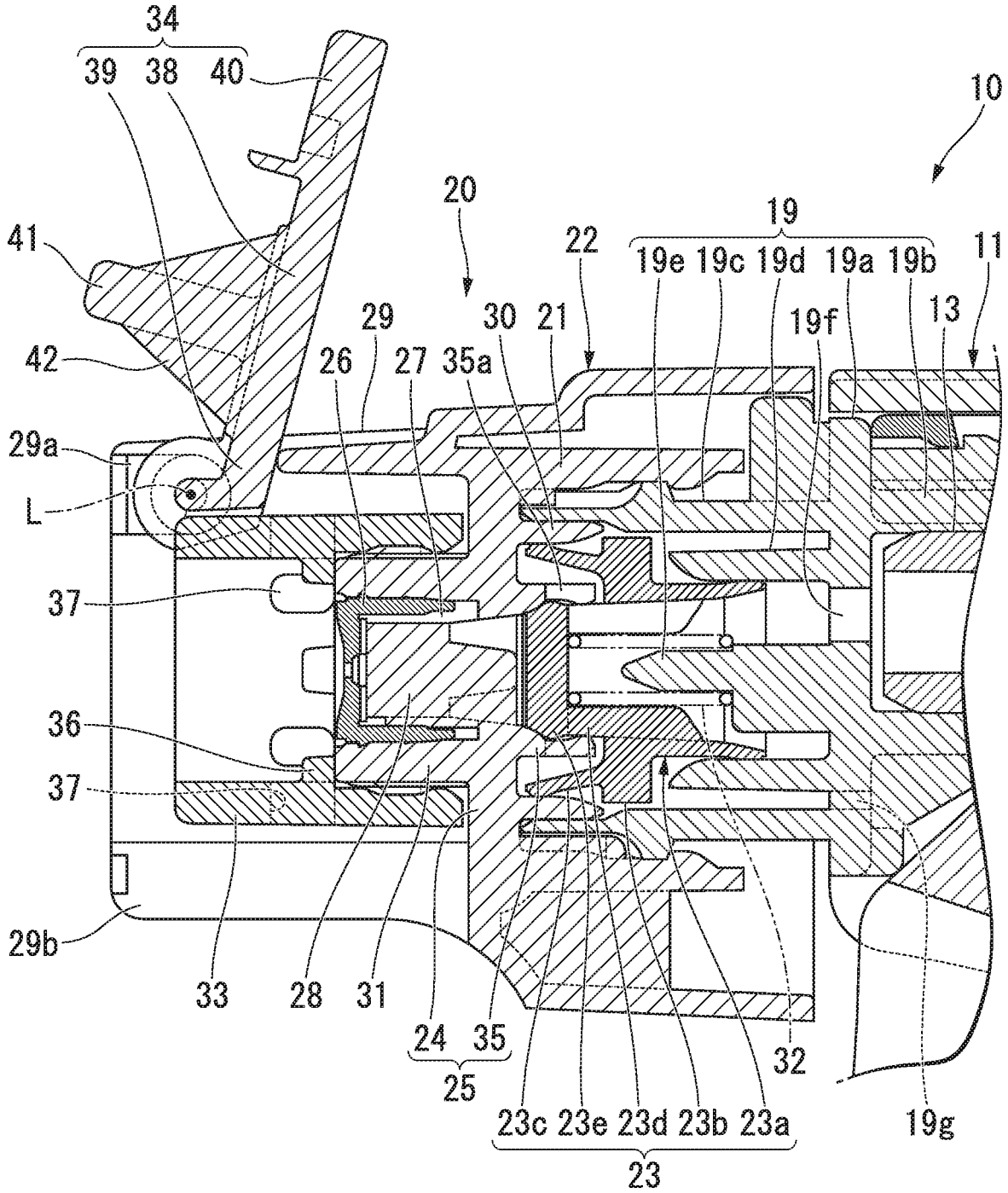
FIG. 3 is an enlarged view of a main portion of the trigger-type liquid ejector shown in FIG. 1, showing a state in which a foam-forming portion is open.

The nozzle member 20 is disposed in the front of the ejector main body 11. As shown in FIG. 2, the nozzle member 20 includes a nozzle main body 22 having a connection tubular portion 21 connected to the injection tubular portion 13, a valve body 23 provided inside the connection tubular portion 21 to be movable rearward and forward in a state in which it is urged forward, a coil spring 32 which urges the valve body 23 forward, a tubular foam-forming portion 33 positioned in the front of the ejection hole 26*a* and configured to surround this ejection hole 26*a*, and a lid body 34 which openably closes the foam-forming portion 33. Here, in the shown example, on an outer circumferential surface of a front side portion of the injection tubular portion 13, a nozzle fitting tubular portion 19 is fitted with the injection tubular portion 13 in a water-tight manner. Thereby, the connection tubular portion 21 is connected to the injection tubular portion 13 via this nozzle fitting tubular portion 19.

The nozzle fitting tubular portion 19 includes a base plate 19*a* extending along a plane perpendicular to the forward and rearward direction, a first fitting tube 19*b* protruding rearward from a rear surface of this base plate 19*a* and fitted to the injection tubular portion 13, a second fitting tube 19*c* protruding forward from a front surface of the base plate 19*a* and having an outer circumferential surface on which the connection tubular portion 21 is fitted, a cylinder tube 19*d* protruding forward inside the second fitting tube 19*c* on the front surface of the base plate 19*a*, and a guide protrusion 19*e* protruding forward inside the cylinder tube 19*d* on the front surface of the base plate 19*a*.

The second fitting tube 19*c*, the cylinder tube 19*d*, and the guide protrusion 19*e* are coaxially disposed. Further, a liquid outflow hole 19*f* is formed at a position on the base plate 19*a* facing a front end opening of the injection tubular portion 13, and the inside of the injection tubular portion 13 and the inside of the cylinder tube 19*d* communicate with each other through the liquid outflow hole 19*f*. Further, an outside air inlet/outlet hole 19*g* through which a gap between the second fitting tube 19*c* and the cylinder tube 19*d* communicates with the outside of this trigger-type liquid ejector 10 is formed on the base plate 19*a*.

The nozzle main body 22 includes a valve seat portion 25 having an annular valve seat plate 24 which is disposed inside the connection tubular portion 21 and on which a front end portion 23*e* of the valve body 23 is seated, a sliding tubular portion 30 protruding rearward from the valve seat plate 24 and disposed on a radial inner side of the connection tubular portion 21, a nozzle tip 28 disposed on the front side of the valve seat portion 25, a cap attachment cylindrical portion 31 surrounding the nozzle tip 28 from a radial outer side thereof, and a covering wall portion 29 which covers the cap attachment cylindrical portion 31 from the radial outer side thereof. Further, the valve seat plate 24, the nozzle tip 28, the sliding tubular portion 30, the cap attachment cylindrical portion 31, and the covering wall portion 29 are coaxially disposed.

The valve seat portion 25 further includes a valve seat sliding tube 35 protruding rearward from the valve seat plate 24. The valve seat sliding tube 35 is disposed coaxially with the sliding tubular portion 30 and is formed to have a diameter smaller than a diameter of the sliding tubular portion 30. The valve seat sliding tube 35 is formed with a plurality of communication holes 35*a* opening toward a rear end thereof at intervals in a circumferential direction. The sliding tubular portion 30 is fitted into the second fitting tube 19*c*. As a result, the second fitting tube 19*c* is fitted in a fixed state between an inner circumferential surface of the connection tubular portion 21 and an outer circumferential surface of the sliding tubular portion 30.

A nozzle cap 26 whose front end is formed with the ejection hole 26*a* and whose rear end is open is fitted into the cap attachment cylindrical portion 31. The nozzle cap 26 is fitted into the cap attachment cylindrical portion 31 from the radial inner side thereof. A nozzle communicating groove 27 extending over the entire length in the forward and rearward direction is formed on an outer circumferential portion of the nozzle tip 28. The nozzle communicating groove 27 communicates with the ejection hole 26*a* and an inside of the valve seat plate 24.

Figure 4:
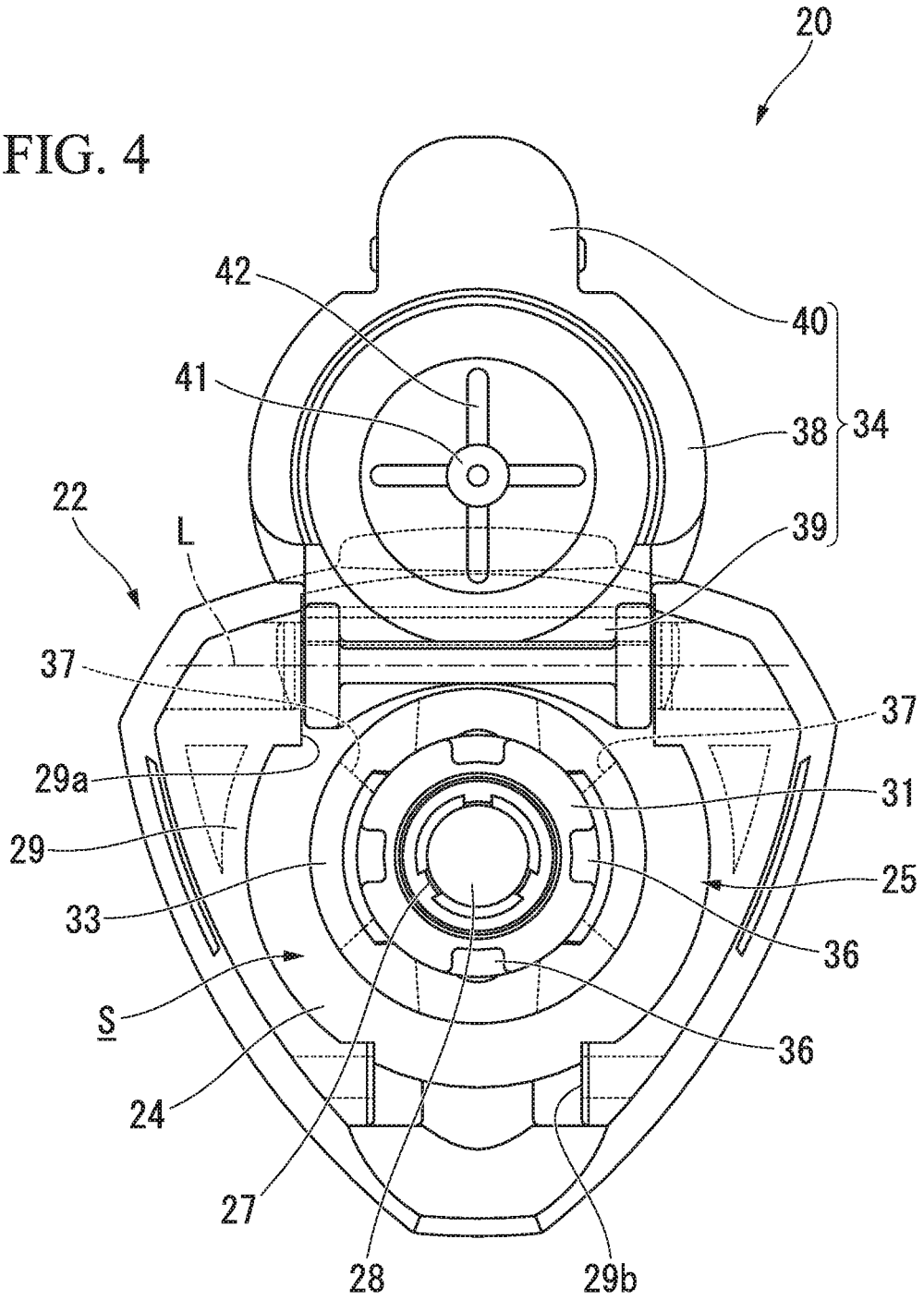
FIG. 4 is a front view of a main portion of the trigger-type liquid ejector shown in FIG. 1, showing a state in which a nozzle cap is detached and the foam-forming portion is open.

As shown in FIG. 4, the covering wall portion 29 is formed in a tubular shape protruding forward from the valve seat plate 24. Notch portions 29*a* and 29*b* recessed rearward are provided at both upper and lower end portions of the covering wall portion 29. The upper notch portion 29*a* provided at the upper end portion of the covering wall portion 29 is larger in a lateral direction than the lower notch portion 29*b* provided at the lower end portion of the covering wall portion 29.

As shown in FIG. 2, the valve body 23 is disposed on the inner side of the second fitting tube 19*c* coaxially with the guide protrusion 19*e* and the valve seat plate 24. The front end portion 23*e* of the valve body 23 is provided to be slidable in a forward and rearward direction inside the valve seat sliding tube 35 with respect to the valve seat plate 24. The valve body 23 includes a tubular valve main body 23*a* whose front end is closed and whose rear end is open, a flange portion 23*b* protruding from an intermediate portion in a longitudinal direction of an outer circumferential surface of this valve main body 23*a*, and a seal tubular portion 23*c* protruding forward from a front surface of this flange portion 23*b*.

A front end portion of the valve main body 23*a* (the front end portion 23*e* of the valve body 23) gradually expands in diameter from a front end toward the rear. A rear end portion of the valve main body 23*a* (a rear end portion of the valve body 23) is fitted to an inner circumferential surface of the cylinder tube 19*d* to be slidable in a forward and rearward direction in a water-tight state. A plurality of through holes 23*d* are formed at intervals in a circumferential direction of the valve main body 23*a* in a portion of the valve main body 23*a* continuous from the front side to the flange portion 23*b*.

The seal tubular portion 23*c* gradually expands in diameter toward the front. The seal tubular portion 23*c* is disposed between an outer circumferential surface of the valve seat sliding tube 35 and an inner circumferential surface of the sliding tubular portion 30 and is fitted to the inner circumferential surface of the sliding tubular portion 30 to be slidable in a forward and rearward direction in a water-tight state. Regardless of whether the valve body 23 is seated on the valve seat plate 24 or whether the valve body 23 is separated from the valve seat plate 24, an inside of the seal tubular portion 23*c* communicates with an inside of the valve main body 23*a* through the communication holes 35*a* and the through holes 23*d*.

The coil spring 32 is disposed inside the valve main body 23*a*. A guide protrusion 19*e* is inserted inside the coil spring 32. The coil spring 32 urges the valve body 23 forward and seats the front end portion 23*e* of the valve body 23 on the valve seat plate 24.

The foam-forming portion 33 is positioned in the front of the valve seat plate 24. The foam-forming portion 33 is formed in a tubular shape and is fitted to the cap attachment cylindrical portion 31 from the outside in the radial direction. An outer diameter of the foam-forming portion 33 is smaller than an inner diameter of the covering wall portion 29, and an annular space S is provided between an outer circumferential surface of the foam-forming portion 33 and an inner circumferential surface of the covering wall portion 29. This annular space S can communicate with the outside through a front end opening and the notch portions 29*a* and 29*b* of the covering wall portion 29.

On an inner circumferential surface of the foam-forming portion 33, a locking protrusion 36 protruding toward an inner side in the radial direction of the foam-forming portion 33 is provided. A plurality of locking protrusions 36 are disposed at intervals around the entire circumference of the foam-forming portion 33. For example, four locking protrusions 36 may be disposed at equal intervals in the circumferential direction of the foam-forming portion 33. That is, a pair of locking protrusions 36 are provided at portions facing each other in a lateral direction on the inner circumferential surface of the foam-forming portion 33, and in addition, a pair of locking protrusions 36 are provided at portions facing each other in a vertical direction on the inner circumferential surface of the foam-forming portion 33. The locking protrusions 36 are locked to a front end opening edge of the cap attachment cylindrical portion 31 from a front side.

An outside air introduction hole 37 is formed in the foam-forming portion 33 to penetrate therethrough in the radial direction thereof. The outside air introduction hole 37 is disposed on a front side of a rear end edge of each of the locking protrusions 36 and is positioned on a front side of the cap attachment cylindrical portion 31. A plurality of outside air introduction holes 37 are disposed at intervals around the entire circumference of the foam-forming portion 33. The plurality of outside air introduction holes 37 are disposed alternately with the plurality of locking protrusions 36 along the circumferential direction of the foam-forming portion 33. The outside air introduction holes 37 become gradually larger in the circumferential direction of the foam-forming portion 33 from the inside to the outside in the radial direction of the foam-forming portion 33.

The lid body 34 is connected to the nozzle main body 22 to be rotatable toward the front. The lid body 34 closes a front end opening of the foam-forming portion 33, and in this embodiment, the lid body 34 also closes a front end opening of the covering wall portion 29. The lid body 34 includes a main body portion 38 fitted into the covering wall portion 29, a connecting piece 39 protruding upward from the main body portion 38 and disposed in the upper notch portion 29*a*, and an operation piece 40 protruding downward from the main body portion 38 and disposed in the lower notch portion 29*b*.

The connecting piece 39 is connected to the covering wall portion 29 to be rotatable around a rotating axis L extending in a lateral direction. Both end portions of the connecting piece 39 in the lateral direction are respectively connected to both circumferential end portions facing each other in the lateral direction with the upper notch portion 29*a* interposed therebetween in the covering wall portion 29. The operation piece 40 protrudes downward from the covering wall portion 29. The operation piece 40 is formed to have the same size as the lower notch portion 29*b* in the lateral direction and is detachably fitted into the lower notch portion 29*b*.

A boss 41 protruding rearward is provided on the lid body 34. The boss 41 abuts the nozzle cap 26 (the nozzle main body 22) and closes the ejection hole 26*a* in a state in which the lid body 34 closes the foam-forming portion 33. The boss 41 is formed in a columnar shape disposed coaxially with the foam-forming portion 33. The boss 41 is reinforced by reinforcing ribs 42. A plurality of reinforcing ribs 42 are provided at intervals in the circumferential direction of the foam-forming portion 33. The reinforcing ribs 42 protrude rearward from the lid body 34 and are connected to an outer circumferential surface of the boss 41.

In the above configuration, when ejecting a liquid, first, the lid body 34 is rotated toward the front to open the foam-forming portion 33. Thereafter, when the trigger 15 is moved rearward (swung rearward) to cause the plunger 14*b* to move rearward with respect to the cylinder 14*a* while elastically deforming the elastic members 51, the inside of the cylinder 14*a* is pressurized and the contents in the cylinder 14*a* rise through the vertical supply tubular pipe 12. As a result, the suction valve 18 is closed, the communication between the inside of the pipe 17 and the inside of the injection tubular portion 13 is blocked, the inside of the injection tubular portion 13 is pressurized, and thereby the contents are injected to each of the insides (the inside of the connection tubular portion 21) of the valve main body 23*a* and the seal tubular portion 23*c* of the valve body 23 through the liquid outflow hole 19*f*, and each of the insides of the valve main body 23*a* and the seal tubular portion 23*c* are pressurized to a predetermined value.

Here, an inner diameter of the seal tubular portion 23*c* is larger than an inner diameter of the valve main body 23*a*. Therefore, when the internal pressures of the valve main body 23*a* and the seal tubular portion 23*c* exceed the predetermined value, the valve body 23 is moved rearward against a forward urging force of the coil spring 32 due to a difference in pressure receiving area between the seal tubular portion 23*c* and the valve main body 23*a*, and the front end portion 23*e* of the valve body 23 separates from the valve seat plate 24. Thereby, the inside of the injection tubular portion 13 and the ejection hole 26*a* communicate with each other through each of the insides of the liquid outflow hole 19*f*, the valve main body 23*a*, and the seal tubular portion 23*c* (the inside of the connection tubular portion 21), the inside of the valve seat plate 24, and the nozzle communicating groove 27 of the nozzle tip 28, and thereby the liquid is ejected from the ejection hole 26*a* through the inside of the foam-forming portion 33.

At this time, outside air (air) is also introduced into the foam-forming portion 33 through the outside air introduction holes 37, and the liquid is mixed with the outside air in the foam-forming portion 33 to form foam which is ejected from the front end opening of the foam-forming portion 33. When the foam-forming portion 33 is short in the forward and rearward direction, it is possible to eject the foamy liquid in a wide range in a dispersed manner, and when the foam-forming portion 33 is long in the forward and rearward direction, it is possible to eject the foamy liquid in a narrow range in a concentrated manner. Further, the liquid ejected from the ejection hole 26*a* into the foam-forming portion 33 is in a mist state. For example, this misty liquid may collide with the inner circumferential surface of the foam-forming portion 33 in the foam-forming portion 33 and disturb a flow of the liquid, thereby being agitated with the outside air to form bubbles.

Thereafter, for example, when the trigger 15 is moved forward (swung forward) on the basis of the elastic restoring force of the elastic members 51 and the plunger 14*b* is moved forward with respect to the cylinder 14*a*, the inside of the cylinder 14*a* is depressurized and gains a negative pressure. Thereby, the suction valve 18 is opened, the inside of the pipe 17 communicates with the inside of the injection tubular portion 13, and the liquid in the container is introduced into the cylinder 14*a* through the pipe 17. At this time, when the internal pressures of the valve main body 23*a* and the seal tubular portion 23*c* (the internal pressure inside the connection tubular portion 21) decrease, the valve body 23 is moved forward by the forward urging force of the coil spring 32. Then, the front end portion 23*e* of this valve body 23 is seated on the valve seat plate 24, and the communication between the inside of the injection tubular portion 13 and the ejection hole 26*a* is blocked.

As described above, according to the trigger-type liquid ejector 10 according to the present embodiment, since the liquid is ejected from the ejection hole 26*a* through the inside of the foam-forming portion 33, it is possible to foam the liquid and eject the foamy liquid. Further, by changing a form of the foam-forming portion 33, as described above, it is possible to adjust a range in which the foamy liquid is ejected. Therefore, when the foam-forming portion 33 is separately formed from the nozzle main body 22 and a modification is limited to a form of the foam-forming portion 33, it is possible to variously adjust a range in which the foamy liquid is ejected without modifying a shape of the nozzle main body 22 and a shape of the ejector main body 11 to which the nozzle main body 22 is connected.

Here, when the liquid is foamed, outside air is introduced into the foam-forming portion 33 from the outside air introduction holes 37 while the liquid is ejected into the foam-forming portion 33, and thereby the liquid is mixed with the outside air to form foam. Here, the liquid ejected into the foam-forming portion 33 is ejected from the ejection hole 26*a* when the internal pressure inside the connection tubular portion 21 exceeds the predetermined value and is ejected at a high speed from the ejection hole 26*a*. Therefore, when the liquid is ejected into the foam-forming portion 33, by reducing the internal pressure of the foam-forming portion 33 to effectively introduce outside air into the foam-forming portion 33 from the outside air introduction holes 37, it is possible to form the liquid into extremely fine bubbles. Thereby, for example, in a case in which the foam-forming portion 33 is formed to be long and the foamy liquid is ejected in a narrow range in a concentrated manner or the like, it is possible to enhance an adhesion force of the liquid to an object as compared with a case in which the liquid is ejected to the object in a liquid state as it is. As a result, it is possible to prevent the liquid colliding with the object from being scattered to the surroundings. That is, when the liquid is ejected in a liquid state (mist state) as it is from the ejection hole 26*a*, since a force of the liquid ejected from the ejection hole 26*a* is excessively strong, there is a possibility of the liquid being scattered to the surroundings depending on objects.

Also, since the lid body 34 is provided in the nozzle member 20, it is possible to reliably prevent unexpected ejection of the liquid.

Further, the technical scope of the present invention is not limited to the above-described embodiment, and various modifications can be made without departing from the gist of the present invention.

For example, the covering wall portion 29, the lid body 34, and the locking protrusion 36 may be omitted.

In addition, the components in the above-described embodiments can be appropriately replaced with well-known components without departing from the spirit and scope of the present invention, and the above-described modified examples may be appropriately combined.

INDUSTRIAL APPLICABILITY

According to the trigger-type liquid ejector of the present invention, a liquid can be foamed and discharged.

REFERENCE SIGNS LIST

10 Trigger-type liquid ejector
11 Ejector main body
12 Vertical supply tubular pipe
13 Injection tubular portion
15 Trigger
20 Nozzle member
21 Connection tubular portion
22 Nozzle main body
23 Valve body
24 Valve seat plate
25 Valve seat portion
26*a* Ejection hole
33 Foam-forming portion
34 Lid body
37 Outside air introduction hole
T Trigger mechanism

What is claimed is:

1. A trigger-type liquid ejector comprising:

an ejector main body mounted on a container in which a liquid is contained; and a nozzle member which is disposed in a front of the ejector main body and in which an ejection hole through which the liquid is ejected forward is formed, wherein the ejector main body includes:

a vertical supply tubular pipe which extends in a vertical direction and through which the liquid in the container is suctioned up;

an injection tubular portion which extends forward from the vertical supply tubular pipe and whose inside communicates with an inside of the vertical supply tubular pipe, and a trigger mechanism including a trigger extending downward from the injection tubular portion and disposed to be swingable rearward in a state of receiving a force, the trigger mechanism being configured to introduce the liquid from the inside of the vertical supply tubular pipe into the injection tubular portion and to inject the liquid from an inside of the injection tubular portion toward the ejection hole side when the trigger swings rearward, and wherein the nozzle member includes:

a nozzle main body including a connection tubular portion connected to the injection tubular portion, and a valve body provided inside the connection tubular portion to be movable rearward and forward in a state of receiving a force, wherein the nozzle main body includes a valve seat portion including an annular valve seat plate which is disposed inside the connection tubular portion and on which a front end portion of the valve body is seated, wherein an inside of the valve seat plate is configured to communicate with the ejection hole, wherein the nozzle member includes a tubular foam-forming portion positioned in a front of the ejection hole and configured to surround the ejection hole, wherein the foam-forming portion is provided with an outside air introduction hole penetrating through the foam-forming portion in a radial direction thereof, wherein the foam-forming portion is separately formed from the nozzle main body and capable of being replaced with another foam-forming portion, wherein on an outer circumferential surface of a front side portion of the injection tubular portion, a nozzle fitting tubular portion is fitted with the injection tubular portion in a water-tight manner, and wherein the connection tubular portion is connected to the injection tubular portion via the nozzle fitting tubular portion.

2. The trigger-type liquid ejector according to claim 1, wherein:

the nozzle member includes a lid body which is configured to selectively open and close the foam-forming portion; and the lid body is connected to the nozzle main body to be rotatable forward.

3. The trigger-type liquid ejector according to claim 2, wherein:

the nozzle main body further includes:

a nozzle tip disposed on a front side of the valve seat portion; and a cap attachment cylindrical portion protruding from the valve seat portion forward and surrounding the nozzle tip on an outside in a radial direction thereof, and the foam-forming portion is fitted to the cap attachment cylindrical portion on an outside in a radial direction thereof and is separately formed from the lid body.

4. The trigger-type liquid ejector according to claim 1, wherein the valve body includes:

a tubular valve main body whose front end is closed and whose rear end is open, a flange portion protruding from an intermediate portion in a longitudinal direction of an outer circumferential surface of the valve main body, and a seal tubular portion protruding forward from a front surface of the flange portion, wherein a plurality of through holes are formed at intervals in a circumferential direction of the valve main body in a portion of the valve main body continuous from a front side to the flange portion, wherein the nozzle main body further includes a sliding tubular portion protruding rearward from the valve seat plate and disposed on a radial inner side of the connection tubular portion, wherein the nozzle fitting tubular portion is fitted in a fixed state between an inner circumferential surface of the connection tubular portion and an outer circumferential surface of the sliding tubular portion, wherein a rear end portion of the valve main body is fitted to an inner circumferential surface of the nozzle fitting tubular portion to be slidable in a forward and rearward direction in a water-tight state, and wherein the seal tubular portion gradually expands in diameter forward and is fitted to an inner circumferential surface of the sliding tubular portion to be slidable in a forward and rearward direction in a water-tight state.

* * * * *